United States Patent [19]

Hagen et al.

[11] Patent Number: 4,750,388

[45] Date of Patent: Jun. 14, 1988

[54] OIL FILTER GRIPPING TOOL

[75] Inventors: Wendall K. Hagen, Bloomington; David M. Haskamp, Minneapolis, both of Minn.

[73] Assignee: Bridge Wheel Co., Inc., Minneapolis, Minn.

[21] Appl. No.: 904,679

[22] Filed: Sep. 8, 1986

Related U.S. Application Data

[63] Continuation-in-part of Ser. No. 748,912, Jun. 26, 1985.

[51] Int. Cl.[4] ..... B25B 13/52

[52] U.S. Cl. ..... 81/64; 81/3.43; 81/177.7

[58] Field of Search ..... 81/3.43, 3.44, 64, 65.2, 81/68–70, 424, 177.75, 177.7; 403/58; D8/21, 22, 23

[56] References Cited

U.S. PATENT DOCUMENTS

| | | | |
|---|---|---|---|
| D. 261,722 | 11/1981 | Rocheleau . | |
| 298,872 | 5/1884 | May . | |
| 438,043 | 10/1890 | Webster . | |
| 635,662 | 10/1899 | Colkitt et al. . | |
| 693,353 | 2/1902 | Erwin . | |
| 700,752 | 5/1902 | Erwin . | |
| 780,818 | 1/1905 | Schlegle . | |
| 970,365 | 9/1910 | Bain . | |
| 1,347,764 | 7/1920 | Shirley . | |
| 1,410,390 | 3/1922 | Dudek . | |
| 1,422,626 | 7/1922 | Shank | 81/3.43 |
| 1,456,671 | 5/1923 | Buckwalter . | |
| 1,496,906 | 6/1924 | Sacre . | |
| 1,513,164 | 10/1924 | Euverard . | |
| 1,670,583 | 5/1928 | Lawrence . | |
| 2,407,421 | 9/1946 | Herold | 403/58 |
| 2,436,366 | 2/1948 | Slater | 403/58 |
| 2,499,030 | 2/1950 | Moon | 403/58 X |
| 2,899,225 | 8/1959 | Birr | 403/58 |
| 3,205,735 | 9/1965 | Martin | 81/68 |
| 4,114,481 | 9/1978 | Kowalczyk . | |
| 4,290,762 | 9/1981 | Lapeyre | 403/58 X |
| 4,561,797 | 12/1985 | Aldridge | 403/58 |
| 4,604,920 | 8/1986 | Dupke . | |

FOREIGN PATENT DOCUMENTS

| | | | |
|---|---|---|---|
| 1075771 | 10/1954 | France | 81/65.2 |

*Primary Examiner*—Frederick R. Schmidt
*Assistant Examiner*—Bradley I. Vaught
*Attorney, Agent, or Firm*—Burd, Bartz & Gutenkauf

[57] ABSTRACT

An oil filter gripping tool including a looped band, the ends of which are connected to scissors levers through a pair of double pivot hinges. The hinges allow movement of the levers to tighten the band to contract to closely fit and grip the oil filter. With the band tightened about the oil filter, turning the levers causes rotation of the oil filter. The hinges also allow the levers to be laterally moved to avoid engine and vehicle parts.

9 Claims, 1 Drawing Sheet

OIL FILTER GRIPPING TOOL

CROSS REFERENCE TO RELATED APPLICATION

This application is a continuation-in-part of U.S. application Ser. No. 748,912, filed June 26, 1985.

FIELD OF INVENTION

This invention relates to a hand tool for tightening and loosening the oil filter associated with an engine of a motor vehicle.

BACKGROUND OF INVENTION

Automobile and truck engines contain more components in less space than they did in years past. Thus, the modern motor vehicle engine compartment has less available space for accommodating and servicing certain engine parts, such as oil filters.

Prior devices for gripping oil filters have had many disadvantages. One major difficulty is that the devices are unable to be attached to the filter without time consuming delays. Another common difficulty is rotating the tools once attached. Often the rotation route is inhibited by engine, wheel suspension and frame parts. Since space is limited, not all of the devices can be turned properly.

SUMMARY OF THE INVENTION

This invention is directed to a gripping tool for rotating an oil filter mounted on the engine of a motor vehicle. The object of the present invention is to provide an easily attachable tool for rotating oil filters which can be readily positioned and re-positioned before and during rotation thereof in the tightening or loosening of an oil filter mounted on an internal combustion engine.

The oil filter gripping tool comprises a looped band to grip the outside of the housing of an oil filter. The band has overlapping and proximate ends so as to provide a firm circumferential grip on the filter fastened to the ends of the band through a pair of bi-directional or double pivot hinges. The first end of the band is spaced outwardly from the second end. One hinge is attached to the first end of the band. Another hinge is attached to an intermediate position spaced from the second end of the band so that the ends of the band overlap each other. When the lever is tightened, the looped band contracts causing it to closely fit and grip the outside of the oil filter. The band is self tightening in one direction of rotation. Each of the hinges has U-shaped members having four pairs of ears. The first U-shaped member has a first pair of ears fastened to the outside of the band. These ears are sufficiently spaced from each other so as to overlap a second pair of ears of the second U-shaped member. A third U-shaped member having a third pair of ears are identical to the second pairs of ears and normally disposed thereto. The inner ends of the lever are sufficiently spaced so as to overlap the third pair of ears. A pivot pin connects the inner ends of the lever to the third pair of ears. The double pivot hinges allow the lever to be positioned and/or re-positioned without moving the position of the band contracted around the oil filter before and during rotation of the oil filter. The levers can be located in positions that allow the hand of the mechanic to apply a strong squeezing force on the levers and allow the tool to be moved in a circumferential direction to rotate the oil filter.

DESCRIPTION OF PREFERRED EMBODIMENT

Figure 1:
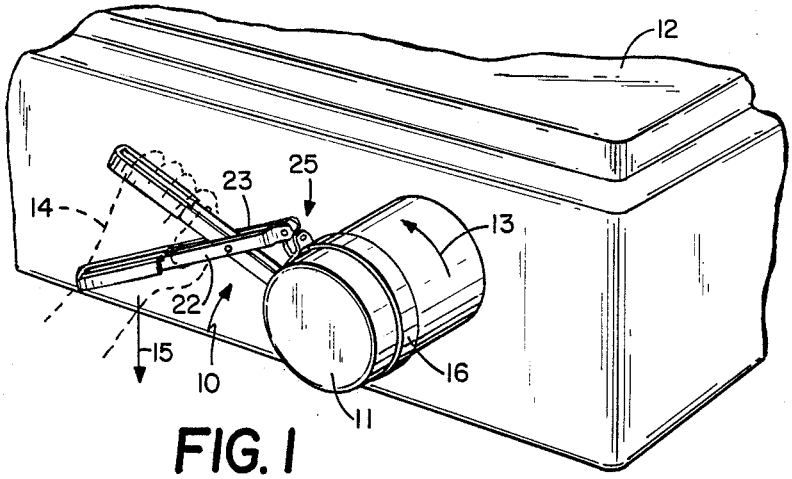
FIG. 1 is a perspective view of the oil filter gripping tool of the invention used to remove an oil filter from the block of an internal combustion engine.

Referring to FIG. 1, an oil filter gripping tool, indicated generally at 10, is used to turn an automotive type oil filter 11 to remove it from the block of an internal combustion engine 12. Filter 11 is mounted on the block of engine 12 with threaded members (not shown) so that rotation of filter 11 in the direction of arrow 13 is necessary to remove the filter from the engine block. A mechanics hand 14 exerts a downward force indicated by arrows 15 on oil filter gripping tool 11 to provide the necessary counterclockwise movement and gripping force on the outside of filter 11 to remove it from the engine block. Rotation of the filter 11 in the opposite direction attaches it to the engine block. Tool 10 can be used to tighten filter 11 on the engine block.

Figure 2:
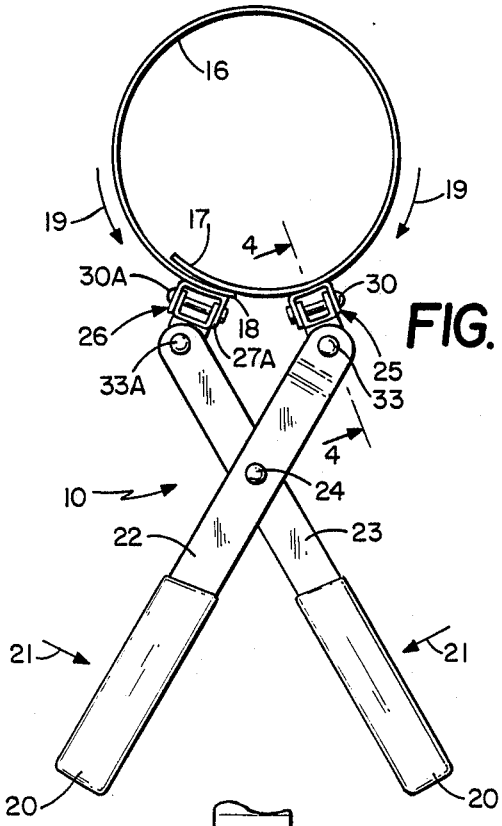
FIG. 2 is an enlarged plan view of the oil filter gripping tool of FIG. 1.

Oil filter gripping tool 10 has a looped band 16 made of a pliable and durable material, such as flexible steel plastic and like material. Band 16 has a uniform width throughout the length thereof to provide a firm grip on the outer wall of filter 11. Preferably, band 16 has a width of 2 to 3 cm. The inside surfaces of band 16 grips a ring segment of the entire circumference of the outer surface of filter 11. As seen in FIG. 2, band 16 has overlapping ends 17 and 18 so that the inner surface of band 16 firmly grips the entire circumferential segment of the outside surface of filter 11. When band 16 is placed about the cylindrical oil filter 11, the tool 10 operates to contract or squeeze the band 16 about the oil filter as indicated by arrows 19 in FIG. 2.

Oil filter gripping tool 10 has a pair of levers 22 and 23 that are pivotally connected together with a pivot member or rivet 24. The levers 22 and 23 are elongated generally U-shaped members. Lever 23 extends through the U-shaped members of lever 22 to form a scissors lever arrangement. Pivot member 24 connects intermediate portions of levers 22 and 23 together. Plastic coats or sleeves 20 are located about the outer ends of levers 22 and 23 to provide convenient hand grips.

A first double pivot hinge 25 articulately secures the inner end of lever 22 to band 16 adjacent outer end 17. A second double pivot hinge 26 articulately connects the inner end of lever 23 to the end 18 of band 16. The hinges 25 and 26 are identical in structure. They allow levers 22 and 23 to be moved relative to each other to open and close band 16. The levers 22 and 23 can also be pivoted or moved to angular or side positions as shown in broken lines in FIG. 3 relative to band 16. This allows levers 22 and 23 to be located in positions so that they may be conveniently utilized to apply gripping force via band 16 to the oil filter 11 and remove the same from the engine block. The oil filters 11 in motor vehicles are located in relatively confined places which have a minimum amount of space for the manipulation of tools to remove the filter from the engine block. The double pivot hinges 25 and 26 allows levers 22 and 23 to be located in selected positions so that the tool can be conveniently used to grip filter 11 and apply a rotational force thereto to remove filter 11 from the engine block.

Figure 4:
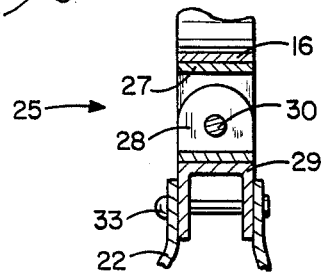
FIG. 4 is an enlarged sectional view taken along the line 4—4 of FIG. 2.
Figure 5:
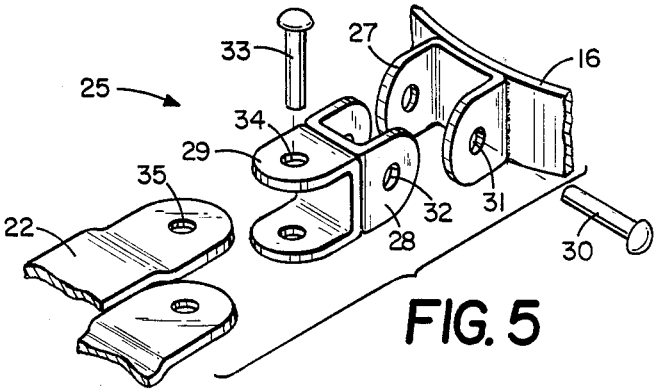
FIG. 5 is an exploded perspective view of the double pivot hinge articulately connecting a lever to the contracting band.

Hinges 25 and 26 are identical in structure and function. The following description is directed to hinge 25. The parts of hinge 26 that correspond with hinge 25 have the same reference number with the suffix A. Referring to FIGS. 4 and 5, hinge 25 has a first U-shaped member 27 secured by welds or the like to band 16 adjacent end 17. As seen in FIG. 2, U-shaped member 27A is secured to band end 18. A second U-shaped member 28 is pivotally mounted on first U-shaped member 27 with a first pivot pin 30, such as a rivet bolt or like pivot member. Pin 30 extends through aligned holes 31 and 32 in the overlapped ears of U-shaped members 27 and 28. A third U-shaped member 29 is secured to the back of U-shaped member 28 by welds or the like. The ears of U-shaped member 29 are normal or perpendicular to the ears of U-shaped member 28. U-shaped members 28 and 29 can be a single member. The ends of lever 22 fit over the ears of U-shaped member 29. A pin 33 fits through aligned holes 34 and 35 in U-shaped member 29 and ends of lever 22. Pin 33 can be a rivet bolt or like pivot member. Pivot members 30 and 33 are laterally spaced from each other and are located in axes that are perpendicular to each other. Pivot members 30 and 30A are circumferentially aligned with band 16 and allow levers 22 and 23 to swing in opposite directions relative to the plane of band 16 as shown in broken lines in FIG. 3. Pivot members 33 and 33A are parallel to pivot member 24 and perpendicular to the plane of band 16 and allow the inner ends of levers 22 and 23 to be moved relative to each other to affect tightening of band 16 about oil filter 11 or alternatively releasing band 16 from filter 11. The double pivot hinges 24 and 25 permit the oil filter gripping tool 10 to be operated without interference from other automotive parts in close proximity to filter 11. Levers 22 and 23 can be positioned and re-positioned to allow the tool 10 to be rotated in a relatively confined area.

Figure 3:
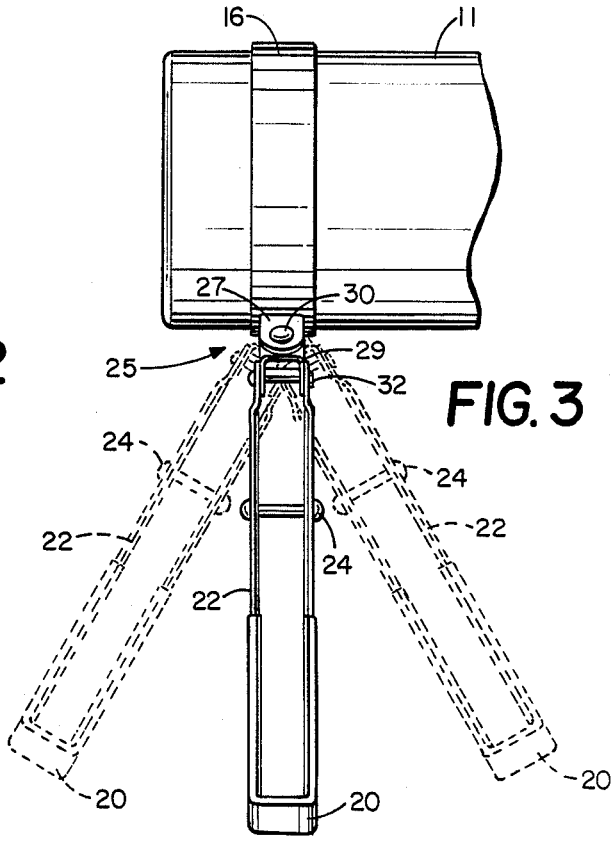
FIG. 3 is a side view of the oil filter gripping tool located in operative engagement with an oil filter.

In use, band 16 is placed over filter 11 as shown in FIGS. 1 and 3. Hand 14 applies a squeezing force on the outer end sections of levers 22 and 23. This tightens band 16 around filter 11. When the levers 22 and 23 are moved in a counterclockwise direction, as shown in FIG. 1, the band 16 is self tightening. Levers 22 and 23 can be pivoted laterally toward or away from block 12 so they can be arcuately moved without interference from parts of the engine, frame, body, or suspension system of the vehicle.

While there has been shown and described a preferred embodiment of the oil filter gripping tool of this invention, it is understood that changes in structure, materials, sizes, and shapes can be made by those skilled in the art without departing from the invention. The invention is defined in the following claims.

The embodiments of the invention in which an exclusive property or privilege is claimed are defined as follows:

1. A tool used to turn a motor vehicle oil filter comprising:

a flexible looped band adapted to fit about a motor vehicle oil filter, said band having an inside surface and adjacent first and second ends, said second end overlapping a portion of the inside surface adjacent the first end, lever means connected to said first and second ends operable to contract said inside surface of the band into complete circumferential tight gripping relation about said filter, said lever means comprising a first lever connected to the first end of the band and a second lever connected to the band adjacent the second end thereof, pivot means connecting adjacent mid-sections of said first and second levers, first hinge means connecting the first lever to the first end of the band, and second hinge means connecting the second lever to the band adjacent the second end thereof, each hinge means having a first U-shaped member secured to the band, a second U-shaped member, a first pivot member pivotally connecting the first and second U-shaped members together, said first pivot member being circumferentially aligned with the band whereby said levers can be moved laterally relative to said band, a third U-shaped member secured to the second U-shaped member, a second pivot member connecting one of the levers to the third U-shaped member, said second pivot member having an axis generally perpendicular to said first pivot member whereby said levers are movable relative to each other about the pivot means to selectively contract and expand said band and the levers can be pivoted on the first pivot member of each hinge means whereby the levers can be laterally pivoted relative to the band.

2. The tool of claim 1 wherein: said first and second levers each comprise an elongated U-shaped member having ends accommodating said second pivot member.

3. The tool of claim 1 wherein: said first and second U-shaped members have overlapping ears with aligned holes accommodating the first pivot member.

4. The tool of claim 1 wherein: each third U-shaped members has ears located adjacent an end of lever, said ears and end of the lever having aligned holes accommodating the second pivot member.

5. The tool of claim 1 wherein: said first and second U-shaped members have overlapping first ear means with aligned holes accommodating the first pivot member, and each third U-shaped member has second ear means located adjacent an end of a lever, said second ear means and end of the lever having aligned holes accommodating the second pivot member.

6. A tool used to turn a motor vehicle oil filter comprising:

a flexible looped band adapted to fit about a motor vehicle oil filter, said band having an inside surface and first and second end sections, each end section having an end, said first end section overlapping said second end section, lever means connected to said first and second end sections operable to contract said inside surface of the band into complete circumferential tight gripping relation about said filter, said lever means comprising a first lever connected to the first end section of the band spaced from the end thereof and a second lever connected to the second end section of the band, pivot means connecting adjacent mid-sections of said first and second levers, and first and second hinge means connecting the first and second levers to said first and second end sections of the band respectively, each of said hinge means having first and second pivot members normally located relative to each other allowing the levers to be pivoted about one of said first and second pivot members laterally relative to said band and pivoted about said pivot means relative to each other to selectively contract the inside surface of the ends circumferentially about said filter and expand said band whereby the band can be removed from the filter.

7. The tool of claim 6 wherein: said first and second levers each comprise an elongated U-shaped member having ends accommodating said second pivot members.

8. The tool of claim 6 wherein: each hinge has a first U-shaped member and a second U-shaped member, said first pivot member pivotally connecting the first and second U-shaped members together, said first pivot member being circumferentially aligned with the band whereby said levers can be moved laterally relative to said band, a third U-shaped member secured to the second U-shaped member, said second pivot member connecting one of the levers to the third U-shaped member, said second pivot member having an axis generally perpendicular to said first pivot member whereby said levers are movable relative to each other to selectively contract and expand said band.

9. The tool of claim 8 wherein: said first and second U-shaped members have overlapping first ear means with aligned holes accommodating the first pivot member, and each third U-shaped member has second ear means located adjacent an end of a lever, said second ear means and end of the lever having aligned holes accommodating the second pivot member.

* * * * *